US005287984A

United States Patent [19]

Michael

[11] Patent Number: 5,287,984

[45] Date of Patent: Feb. 22, 1994

[54] SILVERWARE BASKET LID

[75] Inventor: Daryl A. Michael, Newton, Iowa

[73] Assignee: Maytag Corporation, Newton, Iowa

[21] Appl. No.: 958,085

[22] Filed: Oct. 8, 1992

Related U.S. Application Data

[63] Continuation of Ser. No. 804,772, Dec. 9, 1991, abandoned.

[51] Int. Cl.[5] ..... B65D 43/16

[52] U.S. Cl. ..... 220/331; 220/555

[58] Field of Search ..... 220/523, 329, 330, 331, 220/333, 555

[56] References Cited

U.S. PATENT DOCUMENTS

| | | | |
|---|---|---|---|
| D. 201,292 | 6/1965 | Mundt | D44/29 |
| D. 254,187 | 2/1980 | Freese | D15/36 |
| D. 306,786 | 3/1990 | Ling | D32/3 |
| 3,182,854 | 5/1965 | Geller | 220/83 |
| 3,348,729 | 10/1965 | Ettlinger | 220/83 |
| 3,665,943 | 5/1972 | Lampman | 134/200 |
| 3,934,728 | 12/1976 | Guth | 211/128 |
| 3,935,958 | 2/1976 | Frangos | 220/19 |
| 3,960,290 | 6/1976 | Yake et al. | 220/338 |
| 4,157,145 | 6/1979 | Jordan | 220/19 |
| 4,192,432 | 3/1980 | Jordan | 220/83 |
| 4,339,051 | 7/1982 | Crawford | 220/66 |
| 4,498,594 | 2/1985 | Elder | 211/181 |
| 4,732,291 | 3/1988 | McConnell | 220/19 |
| 4,748,993 | 6/1988 | Llewellyn | 134/166 |
| 4,830,200 | 5/1989 | Zambano | 211/181 |

*Primary Examiner*—Joseph Man-Fu Moy

*Attorney, Agent, or Firm*—Zarley, McKee, Thomte, Voorhees, & Sease

[57] ABSTRACT

An improved silverware basket is provided for a dishwasher. The basket has opposite side walls, opposite end walls, a bottom wall, and an internal dividing wall which define compartments within the basket. One of the compartments is provided for a lid so that small and lightweight objects can be housed within the compartment. The lid is slidably and pivotally mounted within angularly disposed slots in the side walls of the basket for movement between open and closed positions with respect to the compartment.

22 Claims, 3 Drawing Sheets

SILVERWARE BASKET LID

This is a continuation of copending application Ser. No. 07/804,772 filed on Dec. 9, 1991, now abandoned.

BACKGROUND OF THE INVENTION

Conventional dishwashers have a washing chamber in which upper and louver racks are movably mounted. The racks typically are a lattice structure adapted to hold items such as dishes, plates, glasses, cups, pots and pans for washing within the chamber. The racks are rollably or slidably supported on the side walls of the dishwasher so as to be forwardly movable to a position substantially outside the washing chamber for easy loading and unloading of the items. One of the racks normally has a silverware basket mounted or formed therein for holding knives, forks and spoons.

Some silverware baskets have a compartment for holding small items, such as baby bottle nipples and caps, small lids, and similar objects which cannot be held in place in the lattice structure of the racks. Some silverware baskets provide a lid for closing the compartment. Such lids normally are pivotally mounted upon the basket for movement between an open position providing access to the compartment and a closed position closing the compartment. However, these lids are awkward to move between the open and closed positions, and tend to fall from the open to the closed position. Also, since the lid extends substantially above the upper edge of the basket when in the open position, it is easy to accidently knock the lid from the open to the closed position. Furthermore, if the compartment is left open during the wash cycle, the height of the lid above the edge of the basket tends to partially block the spray of water onto silverware and other items contained in the basket.

SUMMARY OF THE INVENTION

A primary objective of the present invention is the provision of an improved silverware basket for use in a dishwasher.

Another objective of the present invention is the provision of a dishwasher silverware basket having a compartment therein and a lid for selectively closing the compartment.

Still another objective of the present invention is the provision of a pivotal and slidable lid for a silverware basket compartment.

Yet another objective of the present invention is the provision of an improved dishwasher silverware basket, and lid therefore, which is economical to manufacture and durable in use.

The silverware basket of the present invention includes opposite sidewalls, opposite end walls, and a bottom wall. The basket also has at least one internal dividing wall so as to define a compartment within the basket adjacent one end thereof. A lid is provided for selectively closing the compartment.

More particularly, the lid for the compartment includes a forward edge, a rearward edge, and opposite side edges. The lid includes a pair of pins extending outwardly from the opposite side edges for pivotal and sliding movement in corresponding slots in the side walls of the basket. The slots are angled at approximately 45°, with a lower end adjacent one end wall of the basket and an upper end spaced apart from the end wall. The axis of the pivot pins is offset with respect to the plane of the lid.

The lid also has cam surfaces on the rearward edge adapted to engage the end wall of the basket when the lid is moved from the open position to the closed position. The cam surfaces function to slide the pivot pins upwardly within the slots in the side wall of the basket as the lid moves from the open position to the closed position. The cams also cooperate with the off-center pivot pins of the lid so as to urge the lid toward the open position after the lid has been moved from the closed position to a predetermined intermediate angular position. As the lid continues to move to the open position, the slots carry the lid downwardly such that the forward edge of the lid is at substantially the same elevation as the upper perimeter edge of the basket. This lowered opened position of the lid minimizes the risk of accidental closure of the lid, and minimizes the blockage of water spray when the lid is maintained in the open position during the wash cycle. Also, the lid moves past a vertical plane when moving from the closed position to the open position, thereby eliminating any tendencies to fall from the open to the closed position.

The sidewalls of the basket also include a detent for releasably securing the lid in the closed position. The lid has a lip or finger grip extending from the forward edge to facilitate the manual release of the lid from the detent.

DETAILED DESCRIPTION OF THE PREFERRED EMBODIMENTS

Figure 1:
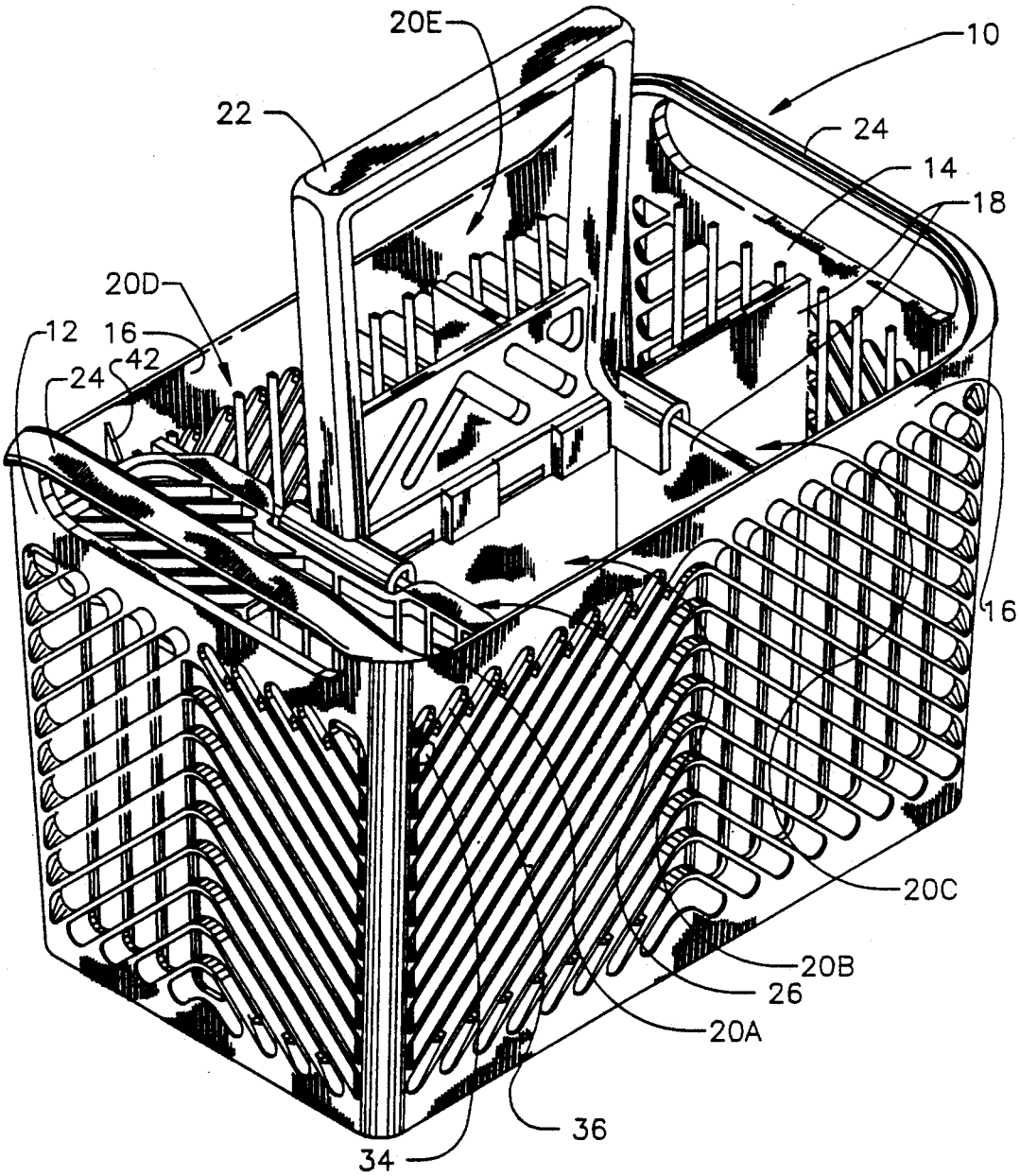
FIG. 1 is a perspective view of a dishwasher silverware basket having the lid of the present invention.
Figure 2:
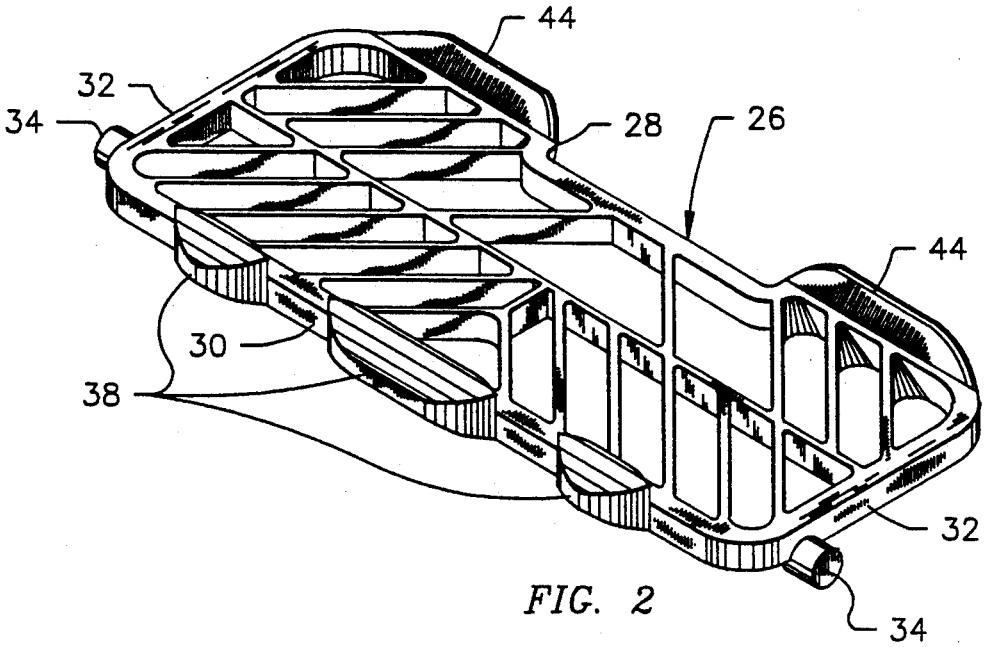
FIG. 2 is a perspective view of the lid.
Figure 3:
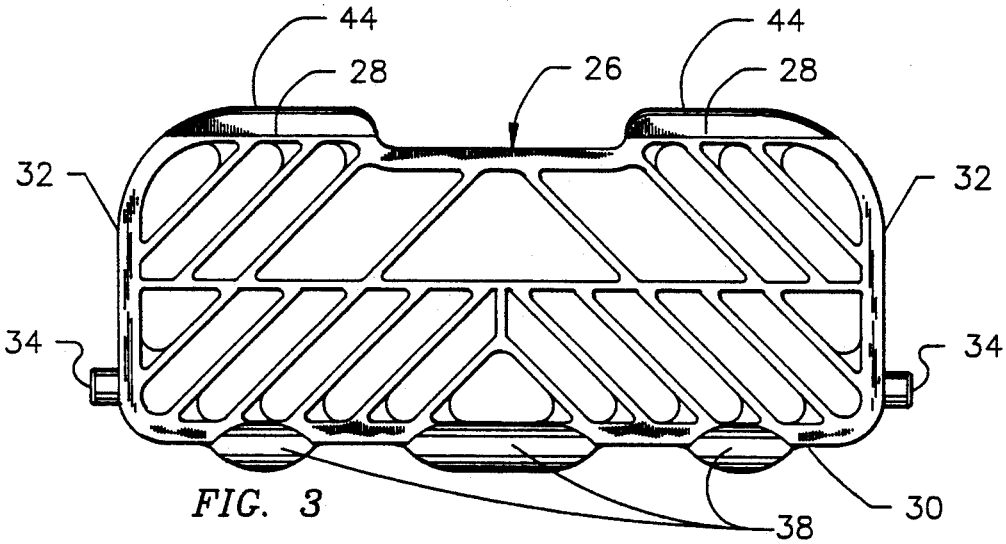
FIG. 3 is a top plan view of the lid.

In the drawings, the reference numeral 10 generally designates a silverware basket for use in a dishwasher. Basket 10 includes a front end wall 12, a rear end wall 14, opposite side walls 16, and a bottom wall 17. Basket 10 also includes a plurality of internal dividing walls 18 which define compartments 20A, 20B, 20C, 20D and 20E. A central handle 22 may be provided on basket 10. Handles 24 may be formed in the end walls 12, 14 of basket 10.

Figure 7:
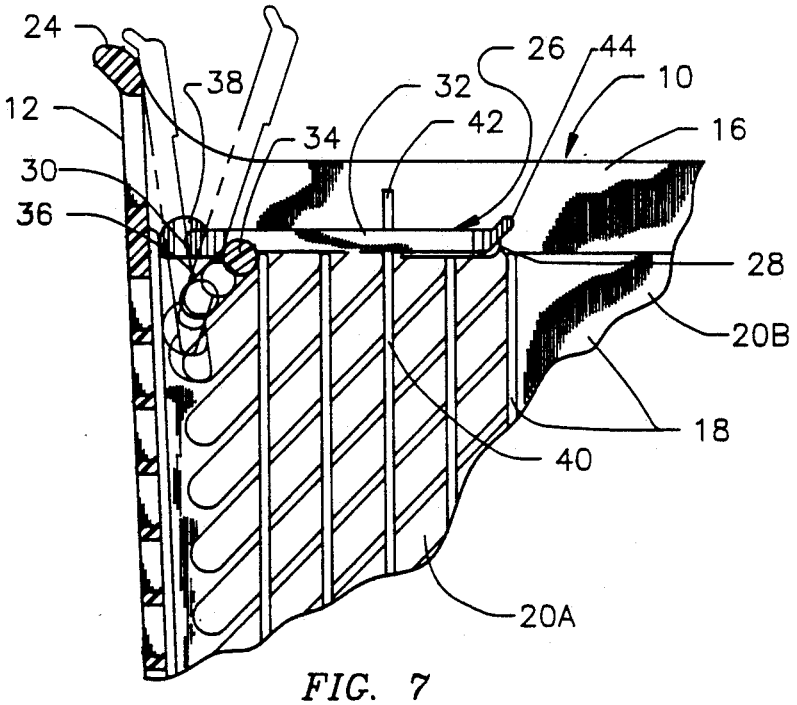
FIG. 7 is a side sectional view taken along lines 7—7 of FIG. 6 showing the lid in the closed position, the opened position, and an intermediate position.

Compartments 2OA–E are adapted to receive silverware and other utensils for washing in a dishwasher. A lid or cover 26 is provided for compartment 20A such that the compartment is especially adapted to receive small and light weight items, such as baby bottle nipples and caps, pacifiers, jar lids and the like. As best seen in FIG. 7, lid 26 is movable between an open position so as to provide access to compartment 20A and so that elongated items such as silverware can be placed in the compartment, and a closed position overlying compartment 20A so that small and lightweight objects will not be blown or ejected out of the compartment by the force of the water spray during the wash and rinse cycles of the dishwasher.

Figure 4:
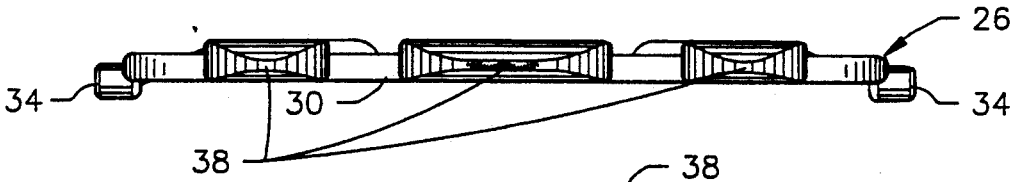
FIG. 4 is an end view of the lid.
Figure 5:
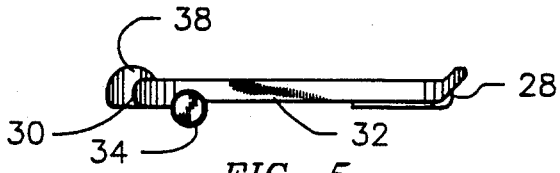
FIG. 5 is a side elevation view of the lid.
Figure 6:
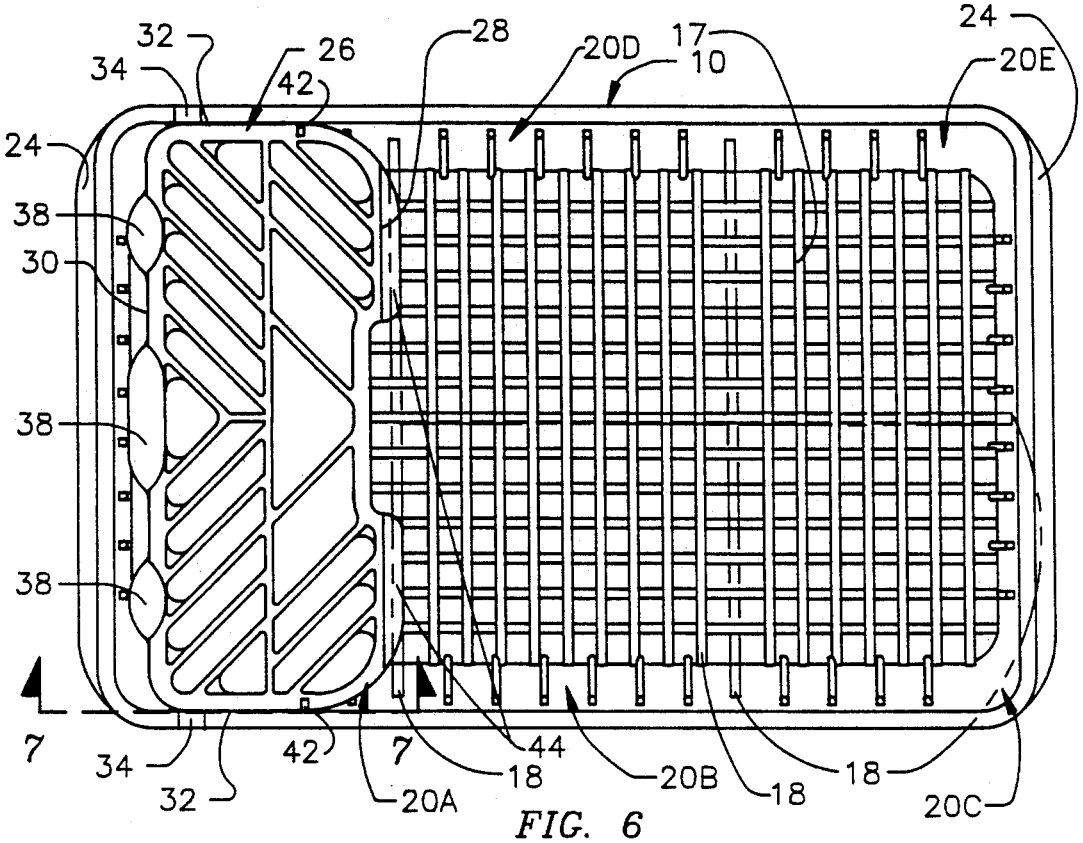
FIG. 6 is a top plan view of the lid in the closed position on the basket.

Lid 26 includes a forward edge 28, a rearward edge 30, and opposite side edges 32. A pair of pivot pins 34 extend outwardly from the side edges 32 adjacent the rearward edge 30 of the lid 26. Pins 34 have a common axis which is offset with respect to the plane of the lid 26, as best seen in FIGS. 4 and 5. Pins 34 are pivotally and slidably received within aligned slots 36 in the opposite side walls 16 of basket 10. Slots 36 are disposed at approximately a 45° angle, with a lower end adjacent front end wall 12 and an upper end spaced apart from the front end wall 12.

Lid 26 also includes cam means 38 on rearward edge 30. In the drawings, cam means 38 are shown as three separate nodules, but it is understood that a single continuous cam surface or a pair of cam surfaces could be provided without departing from the scope of the present invention. Cam nodules 38 are adapted to engage front end wall 12 of basket 10 when the lid is moved from the open to closed position, as described more fully below.

The movement of lid 26 between the open and closed positions is illustrated in FIG. 7. More particularly, FIG. 7 shows the lid 26 in solid lines in the closed position and in broken lines in the open position and an intermediate position. When in the closed position, lid 26 is substantially horizontally disposed and is prevented from moving downwardly by at least one internal rib 40 on the interior of side walls 16. A detent 42 on side wall 16 releasably secures lid 26 in the closed position.

When in the open position, lid 26 is pivoted slightly beyond a vertical plane such that the forward edge 28 thereof engages end handle 24 of basket 10. Thus, lid 26 pivots slightly more than 90° when moving between the open and closed positions. This positioning of lid 26 in the open position eliminates the tendency for the lid 26 to fall to the closed position, as would occur if the lid were vertically oriented.

The forward edge 28 of lid 26 includes a lip 44 for manually grasping to facilitate the movement of the lid 26 between the closed and open positions.

The movement of the lid 26 between the opened and closed positions is coordinated by pins 34, slots 36, and cam means 38. More specifically, when lid 26 is in the open position, cam means 38 are disengaged from front end wall 12 of basket 10 and pivot pins 34 engage the lower end of slots 36. As lid 26 is manually pivoted from the open position to the closed position, cam means 38 engage front end wall 12 of basket 10 so as to slide pivot pins 34 upwardly in slots 36 as the pins 34 pivot in the slots 36. As lid 26 continues to pivot to the closed position, cam means 38 force pins 36 to the upper end of slots 36 such that the lid 26 is substantially horizontally disposed.

In moving from the closed position to the open position, the curvature of cam means 38 allows pivot pins 34 to slide downwardly in slots 36. When lid 26 is moved approximately 55° from the horizontal, the weight of cam means 38 and the offset position of pins 34 effectively bias the lid 26 to the open position.

By allowing pins 34 to slide downwardly in slots 36 as lid 26 is moved to the open position, the forward edge 28 of the lid 26 is at substantially the same elevation as end handle 24 of the basket, as best seen in FIG. 7. This lower positioning of lid 26 in the open position minimizes the blockage of spray when the lid 26 is left open during the washing operation, and minimizes accidental knocking of the lid 26 from the open to the closed position during loading and unloading of the compartment 20A. Lid 26 is a lattice structure, having a plurality of openings therein to allow for the passage of water spray during the washing and rinsing operation of the dishwasher.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

I claim:

1. An improved silverware basket for a dishwasher, the basket having side and bottom walls defining a compartment with an upper perimeter edge, each side wall being substantially vertically oriented and having substantially horizontally disposed upper and lower edges and substantially vertically disposed ends, the improvement comprising:

slots in opposite side walls of the basket disposed at an acute angle with respect to the edges and ends of the side walls; and a lid slidably and pivotally mounted in the slots between the opposite side walls and below the perimeter edge of the compartment for simultaneous sliding and pivotal movement between open and closed positions with respect to the compartment.

2. An improved silverware basket for a dishwasher, the basket having opposite side walls with upper edges, opposite end walls and a bottom wall, and a dividing wall extending between the side walls so as to define a compartment within the basket, the improvement comprising:

a lid for selectively covering the compartment; and mounting means for slidably and pivotally mounting the lid within the basket for simultaneous sliding and pivotal movement between open and closed positions with respect to the compartment.

3. The silverware basket of claim 2 wherein the basket has angularly disposed slots in the side walls of the basket, wherein the lid includes a forward edge, a rearward edge, and opposite side edges, and the mounting means comprising pins extending outwardly from the opposite side edges of the lid for mounting the lid in the slots in the side walls of the basket.

4. The silverware basket of claim 2 further comprising cam means for sliding the lid forwardly relative to one end wall as the lid pivots from the open to the closed positions.

5. The silverware basket of claim 3 wherein the lid is substantially planar and the pins have an axis offset with respect to the plane of the lid.

6. The silverware basket of claim 3 wherein the lid further comprises cam means for slidably moving the lid forwardly in the slots as the lid pivots from the open to closed position.

7. The silverware basket of claim 6 wherein the cam means extends rearwardly from the rearward edge of the lid so as to engage one end wall of the basket as the lid pivots from the open position to the closed position.

8. The silverware basket of claim 7 wherein the cam means disengages the one end wall as the lid moves to the open position.

9. The silverware basket of claim 8 wherein the cam means and the mounting means cooperate to urge the lid to the open position when the lid is moved from the closed position to an intermediate position between the open and closed positions.

10. The silverware basket of claim 3 wherein the forward edge of the lid has an upturned lip for grasping by a person's fingers.

11. The silverware basket of claim wherein the slots have a lower end adjacent one end wall of the basket and an upper end spaced from the one end wall.

12. The silverware basket of claim 2 wherein the basket includes detents on the opposite side walls for releasably securing the lid in the closed position.

13. The silverware basket of claim 2 wherein the basket has an upper perimeter edge and the lid extends upwardly to substantially the same elevation as the perimeter edge when the lid is in the open position.

14. A silverware basket for use in a dishwasher comprising:

side and bottom walls defining at least one compartment;

a pair of substantially aligned slots disposed in opposite side walls of the basket;

cover means having front, rear and side edges and including pivot means located off-center on the side edges and engageable with the slots for manual pivotal operation of the cover means between a first position overlying the compartment and a second substantially retracted position to open the compartment; and cam means on the rear edge of the cover means slidably engageable with a side wall of the basket for slidably moving the pivot means relative to said slots as the cover means is pivotally operated between the first and second positions.

15. The silverware basket of claim 14 wherein the off-center pivot means and the cam means combine to effectively bias the cover means toward the second position when said cover means is operated to a predetermined intermediate angular position.

16. The silverware basket of claim 14 wherein the slots are disposed approximately at a 45° angle.

17. The silverware basket of claim 14 wherein the cover means includes grasping means on the front thereof for manual grasping by a user.

18. The silverware basket of claim 14 wherein the basket includes a handle and the front of the cover means is disposed at substantially the same elevation as the handle when the cover means is in the retracted position.

19. The silverware basket of claim 14 wherein the compartment includes securement means for releasably securing the lid in the first position.

20. The silverware basket of claim 14 wherein tile lid includes a plurality of apertures through which water passes for washing items in the compartment during operation of the dishwasher.

21. The silverware basket of claim 1 further comprising cam means for slidably moving the lid forwardly in the slots as the lid pivots from the open position to the closed position.

22. The silverware basket of claim 21 wherein the cam means are on the lid so as to engage one end wall during movement of the lid from the open to closed positions.

* * * * *